United States Patent [19]

Jones

[11] Patent Number: 4,457,268

[45] Date of Patent: Jul. 3, 1984

[54] VALVE POSITION CONTROL DEVICE

[76] Inventor: Darrell L. Jones, P.O. Box 1024, Mayfield, Ky. 42066

[21] Appl. No.: 342,373

[22] Filed: Jan. 25, 1982

[51] Int. Cl.[3] ..... F01L 1/26

[52] U.S. Cl. ..... 123/90.23; 123/90.24; 123/90.6; 74/568 FS; 74/569

[58] Field of Search ..... 123/90.1, 90.2, 90.22, 123/90.23, 90.24, 90.25, 90.26, 90.39, 90.60; 74/568 R, 568 FS, 569, 570, 581; 251/260, 261

[56] References Cited

U.S. PATENT DOCUMENTS

| | | | |
|---|---|---|---|
| 1,679,794 | 8/1928 | Smith | 123/90.23 |
| 2,466,550 | 4/1949 | Lundquist | 123/52 R |
| 2,641,236 | 6/1953 | Mansfield | 123/90.24 |
| 2,954,017 | 9/1960 | Forstner | 123/90.25 |
| 3,195,528 | 7/1965 | Franklin | 123/90.65 |
| 3,585,974 | 6/1971 | Weber | 123/90.12 |
| 3,641,988 | 2/1972 | Torazza et al. | 123/90.16 |
| 3,911,879 | 10/1975 | Altmann | 123/90.16 |

FOREIGN PATENT DOCUMENTS

| | | | |
|---|---|---|---|
| 559715 | 3/1957 | Italy | 123/90.25 |
| 939895 | 10/1963 | United Kingdom | 123/90.25 |

*Primary Examiner*—Craig R. Feinberg
*Assistant Examiner*—W. R. Wolfe
*Attorney, Agent, or Firm*—Renner, Kenner, Greive & Bobak

[57] ABSTRACT

A device (10) to control the position of a valve (12) in relation to the position of a unidirectionally rotating member (22) includes the use of a valve drive wheel assembly (24) which is movable in a reciprocating rotational manner, a flexible arm assembly (23), and a flexible rod assembly (25). The flexible arm assembly (23) is in operative association with the unidirectionally rotating member (22) and the valve drive wheel assembly (24) for driving the valve drive wheel assembly (24) in rotational reciprocation as the unidirectionally rotating member (22) rotates. Flexible rod assembly (25) linearly reciprocates the valve (12).

16 Claims, 7 Drawing Figures

VALVE POSITION CONTROL DEVICE

TECHNICAL FIELD

The present invention relates generally to a mechanism to control the position of linearly reciprocating valves in engines. More specifically, the present invention pertains to a mechanism to control the linear position of both an inlet valve and exhaust valve in an internal combustion engine relative to the position of a rotating crank.

BACKGROUND ART

The employment of valves which are spring biased to remain closed and are opened by the action of a rotating eccentric shaft or cam acting against the end of the valve stem is well known and widely utilized in the internal combustion engine art but inherently possesses certain disadvantages.

The action of the rotating cam striking the valve stem includes a force component which is transverse to the longitudinal axis of the valve. This force component deleterously effects friction and wear in the valve guide and, after a period of time, substantially reduces efficient valve operation and ultimately may result in the failure of the valve to operate. Also, the non-axial action of the valve induces uneven wear between the valve head and the valve seat and eventually precipitates the destruction of the ability of the valve head to seal against the valve seat. As valve operation continues in the presence of such uneven wear hot spots form between the valve head and valve seat which will quickly effect the metallergic integrity of the valve and expedite failure.

An additional disadvantage of a spring loaded valve is the waste of the energy imparted to the spring by the rotating cam. The energy stored in the spring when it is compressed is not substantially returned to the cam but is dissipated as heat or vibration when the valve seats.

Another difficulty inherent in the spring loaded valve is the internal characteristics of the spring and valve which result in the valve being only partially open for a significant portion of its operational cycle and fully extended for a relatively small portion of the cycle. This characteristic produces relative restriction of gas flow, increased back pressure on the exhaust stroke of the engine and an overall decrease in engine efficiency. In order to obtain greater power output, for applications such as racing engines, it is desirable that an internal combustion engine have a greater rotational velocity range. Operation of an internal combustion engine at increasingly higher rotational velocities will eventually result in the attainment of an engine speed at which the valve spring can no longer respond fast enough to follow the cam. The nonresponsive movement of the spring and valve will decrease the engine's power and efficiency and effectively establish the maximum speed at which the engine can operate.

As the engine's operational maximum revolution per minute (RPM) range is increased the inertial characteristics of the spring and valve make it necessary to select a camshaft that will provide greater valve penetration and one that will open the valve earlier in the operational cycle. Opening the valve earlier in the cycle and increasing the valve penetration consequently results in the valve closing later in the engine's operational cycle. Increasing the open to close time periods of the inlet and exhaust valves of a high RPM engine, which completes a cycle in a shorter period of time than a low RPM engine, inherently requires that the inlet valve begin to open before the exhaust valve closes, resulting in substantial overlapping of the periods where each valves are open. A camshaft which alters low and medium speed valve timing and thus improves the high RPM characteristics will give a lower volumetric efficiency, due to the greater valve overlap, and therefore produce a poorer power output at low and medium speeds than a standard camshaft. Thus it is necessary to compromise between maximum obtainable power and flexibility of performance in lower and medium engine-speed ranges.

To achieve increased valve penetration with the more rapid operational characteristics of high RPM engines it is necessary to increase the strength of the spring so that engagement between the valve and camshaft is maintained through the entire operational cycle. Increasing the spring strength increases the force and energy which must be applied by the cam and correspondingly increases the transverse force component induced by the cam which results in more rapid wear on the valve and valve guide. On the other hand, decreasing the valve penetration restricts the flow of gases and reduces the power of the engine.

A further disadvantage of cam driven spring loaded valves is the inability to adjust valve timing or penetration without removing and exchanging the cam shaft or valve springs.

DISCLOSURE OF INVENTION

It is therefore an object of the present invention to provide a valve position control device which allows increased valve penetration in an engine operating at high rotational velocities.

It is another object of the present invention to provide a valve position control device which transmits force to the valve in a axial direction thus maintaining friction and wear on the valve and valve guide at a minimum.

It is yet another object of the present invention to provide a valve position control device which will induce uniform wear in the valve and valve seat and automatically accomodate and adjust therefore.

It is still another object of the present invention to provide a valve position control device which increases engine efficiency and power by increasing the ratio of time that the valve is fully open as opposed to partially open.

It is a further object of the present invention to provide a valve position control device which directly controls the linear position of the valve and prevents non-responsive valve action at high engine speeds.

It is yet a further object of the present invention to provide a valve position control device which is adjustable to different timing cycles and different valve stroke lengths without dissassembly and exchange of parts.

These and other objects, together with the advantages thereof over existing prior art forms, which will become apparent from the following specification, are accomplished by means hereinafter described.

In general, a device to control the position of a valve in relation to the position of a unidirectionally rotating member includes a valve drive wheel assembly movable in a reciprocating rotational manner, a flexible arm assembly in operative association with the unidirectionally rotating member and the valve drive wheel assembly for driving the valve drive wheel assembly in rotational reciprocation as the unidirectionally rotating member rotates, and a flexible rod assembly carried by the valve drive wheel assembly for linearly reciprocating the valve.

PREFERRED EMBODIMENT FOR CARRYING OUT THE INVENTION

Figure 1:
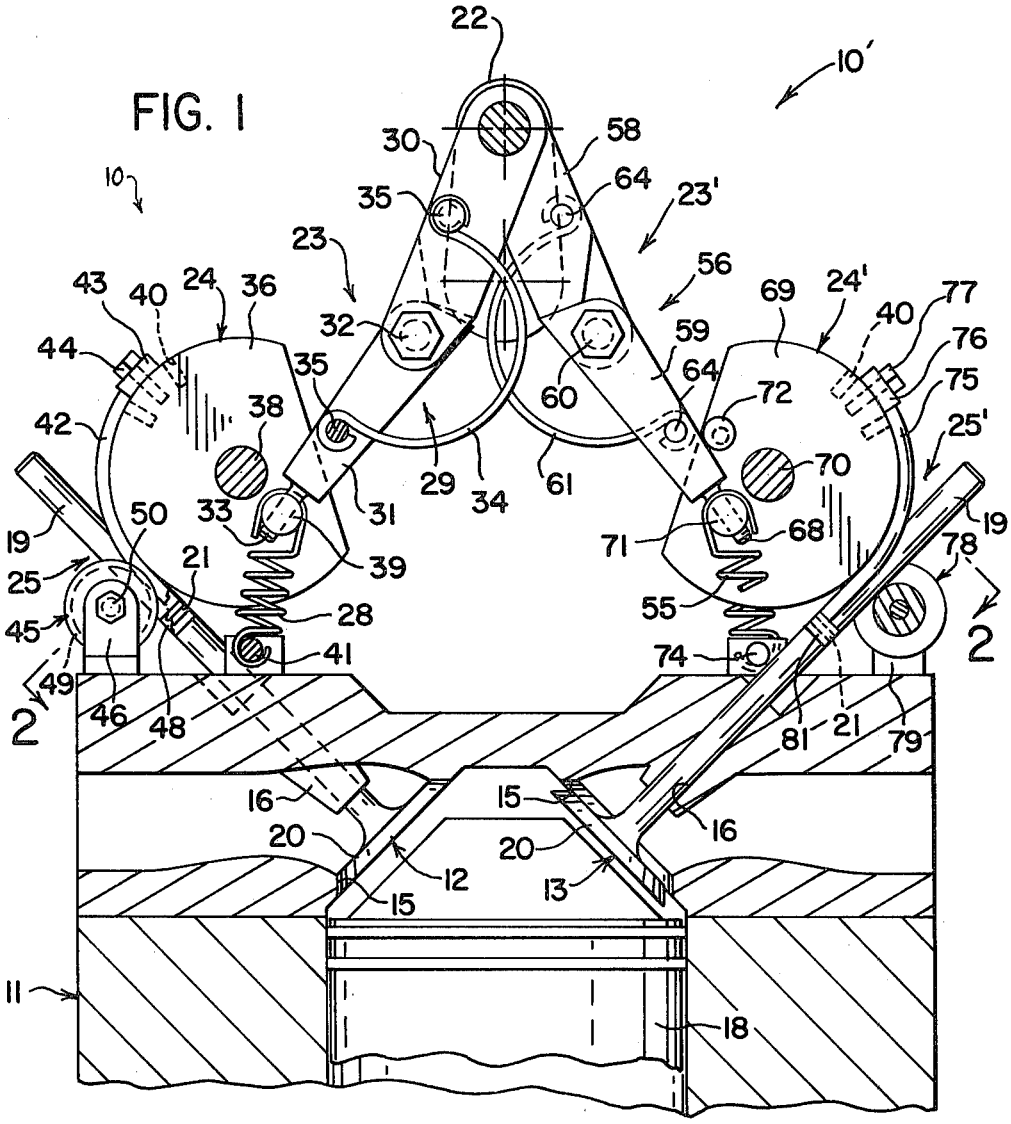
FIG. 1 is a sectional view of a portion of an internal combustion engine particularly depicting an intake and exhaust valve for a single cylinder and a set of valve position control devices embodying the concept of the present invention.

A valve position control device embodying the concept of the present invention is designated generally by the numeral 10 in the accompanying drawings. A set of valve position control devices 10, 10' for an associated set of intake and exhaust valves in an internal combustion engine 11 are shown in sectional view in FIG. 1. The engine 11 is a typical four cycle internal combustion engine, well known in the art, which is representative of the type of engine compatable with the present invention, but it is to be understood that the present invention is also applicable to machines that require similar reciprocating element control. Positioned in the engine 11 in a manner known in the art are inlet valve 12 and exhaust valve 13. Both the inlet and exhaust valves 12 and 13, seat on their respective valve seats 15 and are retained within their respective valve guides 16. Reciprocatingly mounted in engine 11 is piston 18. The valves are of common construction, having a stem 19 and head 20, but with the addition of an annular ring 21 in the valve stem 19 located approximately in the middle of the valve stem 19.

Figure 2:
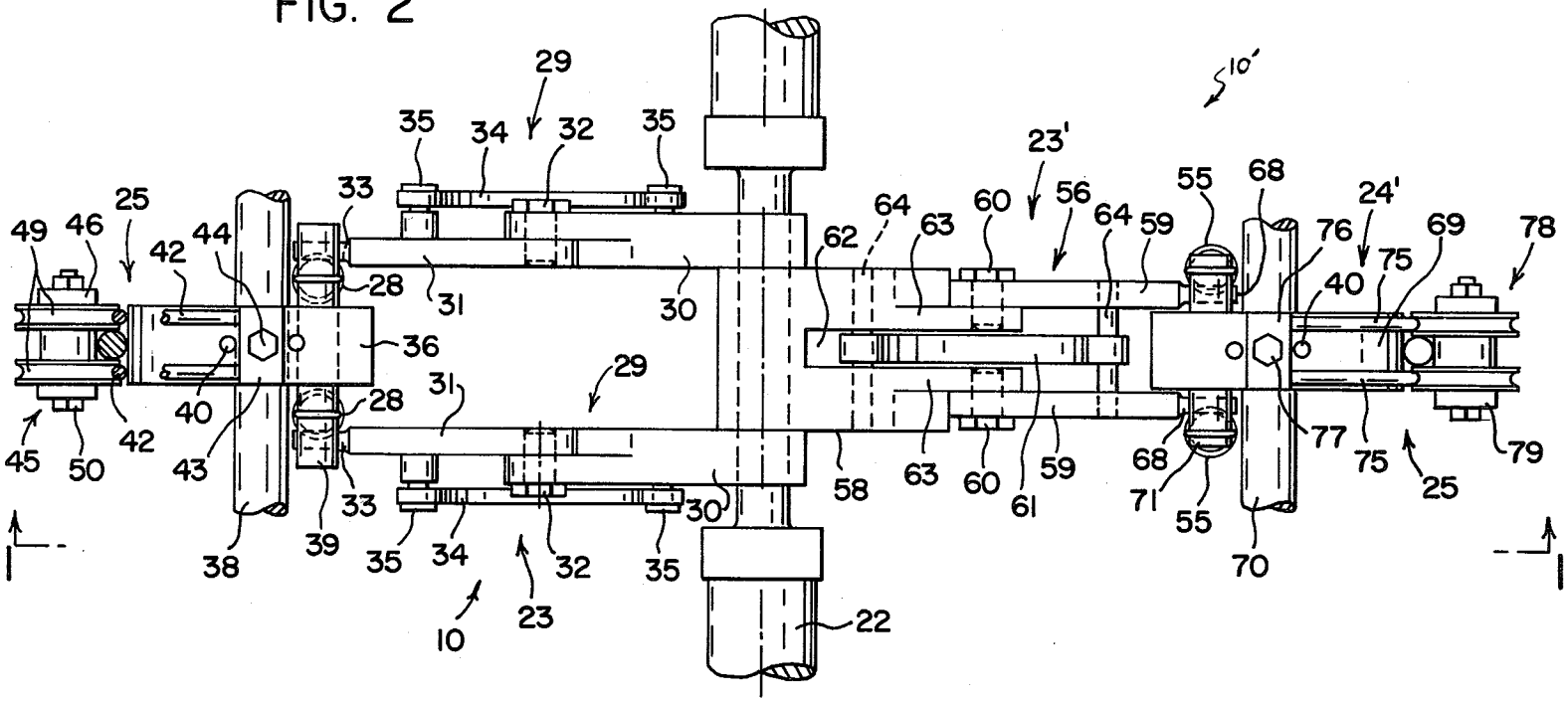
FIG. 2 is a top plan view of the portion of an internal combustion engine shown in FIG. 1.
Figure 7:
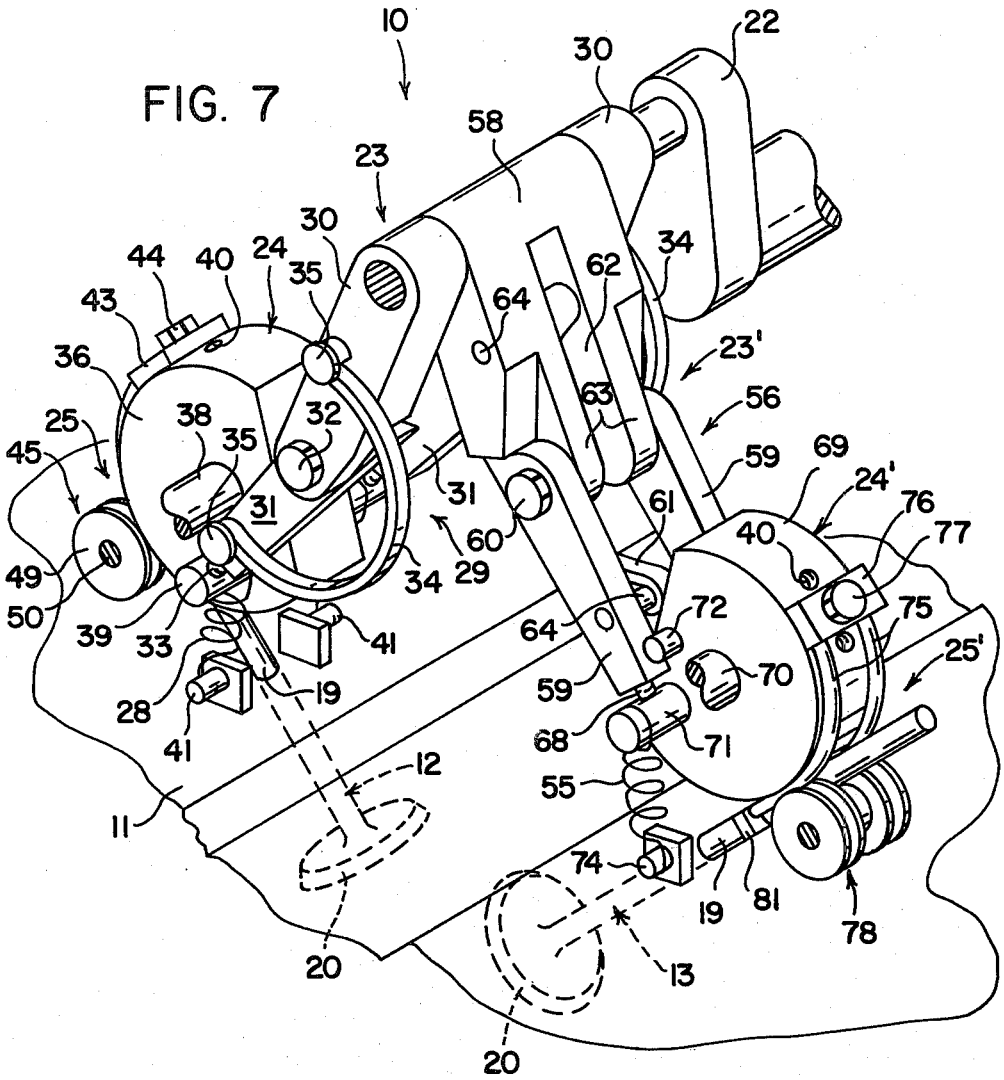
FIG. 7 is a perspective view of a set of valve position control devices in accordance with the present invention, the portion of the valve stems inside the cylinder and the valve heads being drawn in phantom.

As shown in FIGS. 1, 2 and 7 the present invention includes the use of a crank 22 which is rotatably driven by a power source not relevant or shown herein. The rotation of the crank 22 is normally variable with the rotational velocity (i.e., speed) of the engine and can be connected to the main shaft of the engine in a known manner such as, for example, with timing chains and gears.

Inlet valve position control device 10 and the exhaust valve position control device 10' respectively include a flexible arm assembly 23, 23' a valve drive wheel assembly 24, 24' and a flexible rod assembly 25, 25'. The inlet flexible arm assembly 23 is composed of an ancillary spring 28 and an inlet arm 29 one end of which is rotatably mounted on crank 22 and which translates the circular motion of the crank 22 into reciprocating rotational motion in the inlet drive wheel assembly 24.

The inlet arm 29 includes two inner inlet links 30, two outer inlet links 31, two pivot pins 32, two link screws 33 and two link springs 34. The inner inlet links 30 are bar shaped with both ends rounded and with the end inward of the crank 22 being roughly twice the thickness of the other end. Each end of the inner inlet links 30 is suitably bored transverse to the longitudinal axis to respectively receive either the crank 22 or pivot pin 32. The outer inlet links 31 are of a bar shape of uniform thickness and are bored at one end in a direction transverse to the longitudinal axis to receive the pivot pin 32 and bored and threaded on the other end in a direction parallel to the longitudinal axis to receive link screws 33. Located on the respective outer faces of the inner inlet links 30 and outer inlet links 31 are spring anchors 35 which are affixed to or integrally formed with their respective links.

The inner inlet links 30 are connected to the outer inlet links 31 by pivot pins 32 in any suitable manner, such as a bolt and nut, which allows relative rotational motion between the inner inlet links 30 and the outer inlet links 31. As can be best seen in FIG. 1, the center lines of inner inlet links 30 and outer inlet links 31 form an obtuse angle when the links are fully extended thus only permitting the links to bend towards each other on the side opposite the link springs 34. Link springs 34 are attached to the spring anchors 35 and exert force in a direction outward of the pivot pins 32 which tend to resist bending of the links at pivot pins 32 and to limit flexure to one direction. Although the link springs 34 are shown to be semi-circular in shape and rectangular in cross-section any type of spring suitable to exert force on the links in the delineated manner may be taken to be within the spirit of the present invention.

The valve drive wheel assembly 24 is composed of a valve drive wheel 36 rotatably mounted on an axle 38 secured to the engine 11 in any suitable manner neither relevant herein nor shown, and a wheel anchor pin 39 located toward the outer periphery of valve drive wheel 36. The valve drive wheel 36 is a circular wheel with a center bore to accept the axle 38 and a bore to accept the wheel anchor pin 39. The wheel anchor pin 39 is freely rotatable in the valve drive wheel 36 and extends through the valve drive wheel 36 protruding on both sides of the valve drive wheel 36 with threaded bores being provided in the protruding ends to accept the link screws 33 of the respective inlet arms 29. Around the outer periphery of the valve drive wheel 36 is positioned a means to allow selectable positioning of an attachment to the valve drive wheel 36, for example a series of threaded bores 40 disposed in spaced relation around the periphery.

Secured to the wheel anchor pins 39 are ancillary springs 28 which are affixed to the engine 11 at attachment point 41. The ancillary springs 28 are depicted as helical springs but could be any type of spring suitable to exert force on the links in the same manner.

Mounted in the threaded ends of outer inlet links 31 are link screws 33 which are matingly attached to wheel anchor pins 39 through the use of threaded holes in the wheel anchor pins 39 to receive the link screws 33. The link screws 33 allow the adjustment of the relative length of outer inlet links 31 by turning the link screws 33 inwardly or outwardly of wheel anchor pins 39.

The flexible rod assembly 25 includes a pair of flexible rods 42, an attachment bracket 43 and screw 44, a guide wheel 45 and bracket 46, and a valve connection sleeve 48. The flexible rods 42 are cylindrical rods made of a flexible material which will easily bend around the periphery of the valve drive wheel 36 but of sufficient rigidity to push the inlet valve 12 open. The attachment bracket 43 is made to confine and attach the two flexible rods 42 and is adjustably attached to the valve drive wheel 36 by a screw 44. The guide wheel 45 is an assembly having two pulleys 49 rotatably carried on an axle 50 and a bracket 46 mounted on the engine 11. The two pulleys 49 are spaced on the axle 50 to guide and support the flexible rods 42 and are also sufficiently separated to allow the projecting valve stem 19 of inlet valve 12 to axially reciprocate therebetween. The valve connection sleeve 48 is an annular sleeve of an inner diameter smaller than the outer diameter of the valve stem 19 of the inlet valve 12 and of an outer diameter large enough to attach to the flexible rods 42. The valve connection sleeve 48 matingly fits into an annular ring 21 in the inlet valve 12 located approximately in the center of the length of the valve in such a manner to allow the valve to revolve freely in the radial direction but securely join the valve connection sleeve 48 with the inlet valve 12 for axially directed motion.

One end of flexible rods 42 are adjustably attached by the bracket 43 and screw 44 to the periphery of the valve drive wheel 36 and the opposite ends are attached to the inlet valve 12 by the valve connection sleeve 48. Valve connection sleeve 48 should be located such that substantially all force transmitted by flexible rods 42 is directed along the longitudinal axis of inlet valve 12.

A second valve position control device 10' controls the position of exhaust valve 13. The exhaust valve position control device 10' includes all of the essential features described in the inlet valve position control device 10 with modifications necessitated by the need to coordinate the operation of two valve position control devices on one crank 22 and by the opposite positioning of the exhaust valve control device 10'.

The exhaust valve position control device 10' includes a flexible arm assembly 23', a valve drive wheel assembly 24' and a flexible rod assembly 25'.

The exhaust flexible arm assembly 23' is composed of an ancillary spring 55 and an exhaust arm 56 which is rotatably mounted on the crank 22 and which translates the circular motion of the crank 22 into reciprocating rotational motion in the exhaust valve drive wheel assembly 24'.

The exhaust arm 56 includes one inner exhaust link 58, two outer exhaust links 59, two pivot pins 60, and one link spring 61. The inner exhaust link 58 is generally yoke shaped with rounded ends and is formed with a slot 62 which defines two protruding beams 63 in inner exhaust link 58, across which is fixed a spring anchor 64 having a rod attached to or integrally formed with the inner exhaust link 58. The ends of the two protruding beams 63, which mate with the outer exhaust links 59, of the inner exhaust link 58 as defined by slot 62, are approximately one half the thickness of their upper ends and each are bored to receive pivot pins 60. The opposite end of inner exhaust link 58 is bored to accept the crank 22. The outer exhaust links 59 are substantially the same as the outer inlet links 31 previously described but with the modification of having a spring anchor 64 attached or integrally formed across the inner space defined by the outer exhaust links 59. The inner exhaust links 58 are pivotally connected to the outer exhaust links 59 by pivot pins 60. Link springs 61 which are functionally and structurally the same as link springs 34, are attached to spring anchors 64. Link screws 68 adjustably connect the outer exhaust link 59 to the valve drive wheel assembly 24' in the manner described above.

The valve drive wheel assembly 24' is composed of a valve drive wheel 69 rotatably mounted on an axle 70 and a wheel anchor pin 71 rotatably mounted on the valve drive wheel 69. The valve drive wheel assembly 24' is functionally and structurally the same as described above for the inlet valve position control device, but has the additional feature of an impact posts 72 which are positioned on at least one surface of the valve drive wheel 69. The impact post 72 is positioned to cause the outer exhaust links 59 to begin to pivot at a time just prior to the closing of exhaust valve 13 in order to decrease the closing impact force exerted by the exhaust valve 13.

Ancillary springs 55 are of the same construction and perform the same function as the inlet ancillary springs 28 described above, and are secured to wheel anchor pin 71 at attachment point 74.

The flexible rod assembly 25' is composed of a pair of flexible rods 75, an attachment bracket 76 and screw 77, a guide wheel 78 and bracket 79 and a valve connection sleeve 81. All elements of the flexible rod assembly 25' are the same in structure and function as the above described elements of the inlet flexible rod assembly 25.

It is to be understood that the above described flexible arm assemblies 23' can be constructed with varying numbers of links and with varying link configurations without deviating from the scope of the present invention. For example the present invention could be constructed to reciprocately operate one valve by using only one inner link rotatably connected to one outer link by a single pivot pin.

Operation of the present invention effects the transformation of rotational motion into positively controlled and timed reciprocating linear motion in a valve. This transformation is accomplished through the use of the above described spring-biased flexibly joined multiple-element arm, driven by a crank, in conjunction with a rotatably reciprocating valve drive wheel and a flexible rod.

Although the disclosed multiple valve control device controls both the inlet and exhaust valve action in an internal combustion engine, it should be apparent that the concept of the present invention could also be utilized to control only one valve or many valves of spatially aligned pistons and could be utilized on any type of engine or compressor which requires reciprocating valve control.

As seen in FIGS. 3 through 6 the rotation of the crank 22 effects the cyclical flexure and extension of the inlet arm 29 and exhaust arm 56 which connect the crank 22 and the respective valve drive wheels 36 and 69. This cyclical extension and flexure effects the rotational position of the valve drive wheels 36 and 69 which in turn extends or retracts the flexible rods 42, 75 and consequently either opens or closes the attached valves.

In order to control the inlet valve and exhaust valve of a four stroke internal combustion engine the present invention must sequentually open and close both valves in accordance with the different strokes of the piston in the combustion cycle which are essentially power stroke, exhaust stroke, intake stroke or compression stroke.

Figure 3:
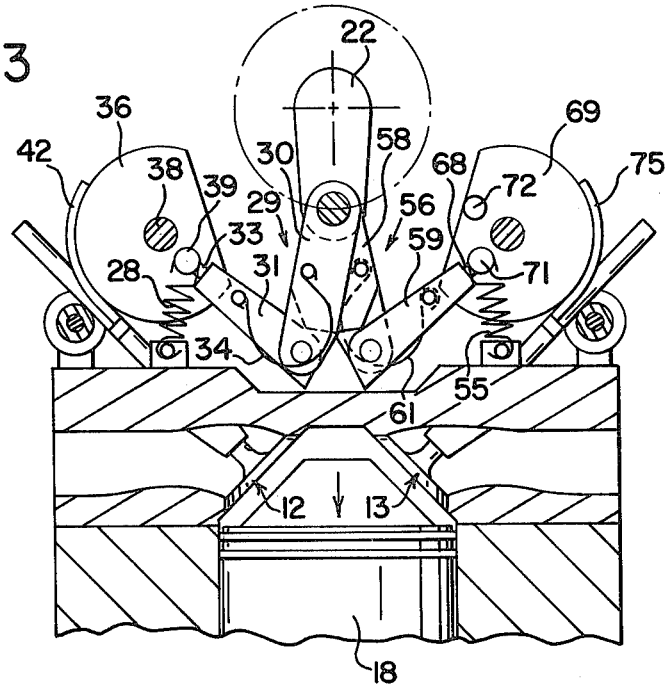
FIG. 3 is a sectional view of the same portion of an internal combustion engine as seen in FIG. 1, showing the valve position control devices in their operational position with both valves closed.

In the power position both valves must be closed as the fuel mixture is ignited and the pressure of the expanding gases force the piston downward. As seen in FIG. 3, the present invention is in the power stroke of the engine with both valves closed. The crank 22 is at the bottom of its revolution and so being has forced the connected inlet arm 29 and exhaust arm 56 into a bent configuration. In this configuration both the inlet arm 29 and the exhaust arm 56 are acted upon by their respective link springs 34 and 61 which exert forces upon the arms that tend to make the inner and outer links pivot away from each other so as to straighten link arms 29 and 56. On the inlet side the force on the outer inlet link 31 tends to cause the valve drive wheel 36 to revolve clockwise which in turn pulls the flexible rods 42 and the inlet valve 12 outward and thus seals the valve. In a similar manner the outer exhaust links 59 exert a force on valve drive wheel 69 in the counter-clockwise direction which results in the exhaust valve 13 sealing and remaining closed.

Also exerting a force upon the valve drive wheels 36 and 69 which tends to rotate each valve drive wheel 36 and 69 in a direction which effects the closure of the valves are ancillary springs 28 and 55. The ancillary springs 28 and 55 are not essential to the operation of the present invention but they do exert a force which is additive to the effect of the link springs 34, 61 and thus allows link springs 34, 61 to be made weaker and correspondingly lighter and smaller, thus enhancing the smooth operation of valve position control devices 10, 10'.

Figure 4:
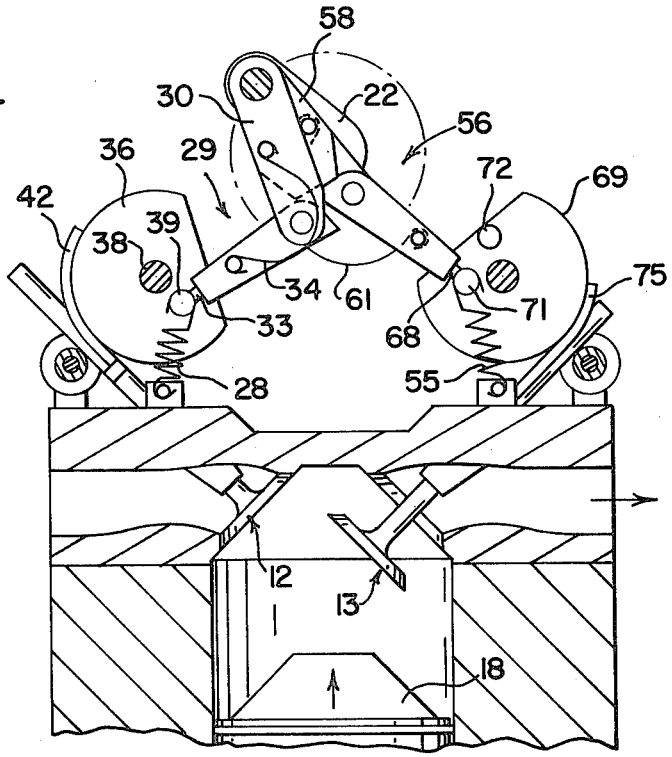
FIG. 4 is a sectional view of the same portion of an internal combustion engine as seen in FIG. 1, showing the valve position control devices in their operational position with the exhaust valve open.

In FIG. 4 the crank 22 has revolved to the middle exhaust position with the exhaust valve 13 at full penetration and the inlet valve 12 closed. As the exhaust arm 56 follows the crank 22 from the combustion stroke to exhaust stroke it is straightened. After the exhaust arm 56 reaches its full extension, the continued rotation of the crank 22 pulls the exhaust arm 56 and rotates the valve drive wheel 69 in the clockwise direction which moves the flexible rod arm 75 around the valve drive wheel periphery and thus pushes the exhaust valve 13 open. Concurrently the inlet arm 29 remains bent and exerts a force on its valve drive wheel 36 which continues to hold the inlet valve 15 closed.

Figure 5:
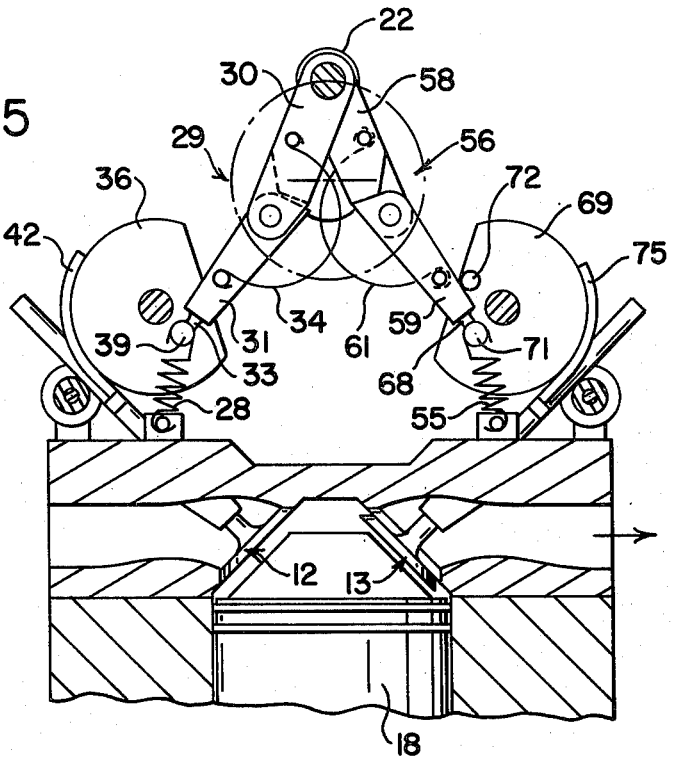
FIG. 5 is a sectional view of the same portion of an internal combustion engine as seen in FIG. 1, showing the valve position control devices in their operational position an instant before the exhaust valve closes.

Continued rotation of the crank 22 pushes the extended exhaust arm 56, which is held rigid by the link spring 61, back towards the valve drive wheel 69 which rotates the valve drive wheel 69 in the counterclockwise direction and thus closes the exhaust valve 13. As seen in FIG. 5, just before the exhaust valve 13 is seated the exhaust arm 56 engages an impact post 72 which retards the closing motion of the valve and allows the exhaust valve 13 to seat with reduced impact.

Figure 6:
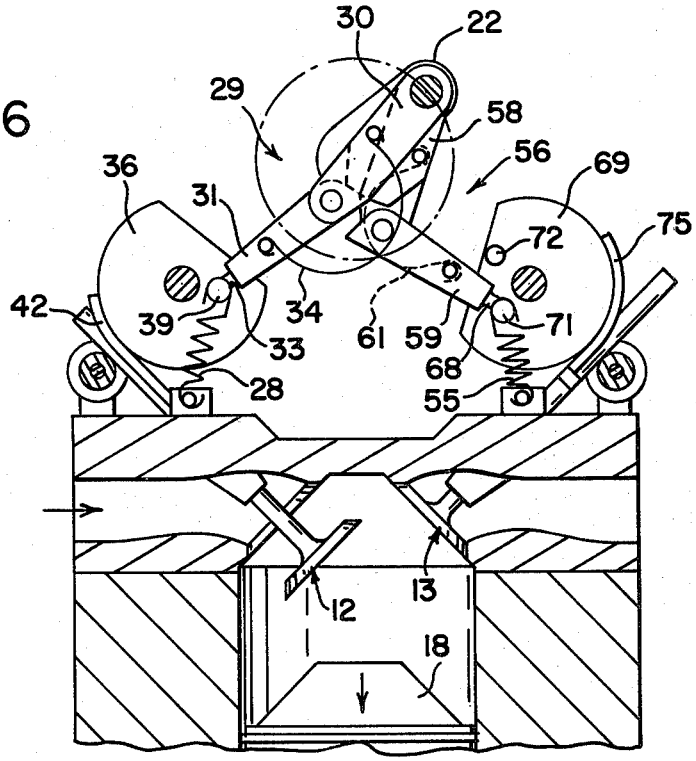
FIG. 6 is a sectional view of the same portion of an internal combustion engine as seen in FIG. 1, showing the valve position control devices in their operational position with the inlet valve open.

The inlet stroke which completes the cycle is disclosed in FIG. 6 with the inlet valve 12 fully opened by the inlet arm 29 pulling the valve drive wheel 36 in the counterclockwise direction which carries the flexible rods 42 inward and pushes the inlet valve 12 open. Also the exhaust arm 56 remains bent and exerts a counterclockwise force on valve drive wheel 69 which holds the exhaust valve 69 closed.

Timing and valve penetration control can be adjusted in the valve position control device without the substitution of modified elements by two alterations. First, the lenth of the outer inlet links 31 and the outer exhaust links 59 may be changed by rotating link screws 33 and 68 relative to their respective outer links and wheel anchor pins 23 and 45. Alternately or additionally, timing and valve penetration can be effected by changing the position of attachment of the flexible rods 42 and 75 on the periphery of valve drive wheels 36 and 69 through the utilization of the adjusting brackets 43, 76 and screws 44 and 77.

Inasmuch as the present invention is subject to many variations, modifications and changes in detail, a number of which have been expressly stated herein, it is intended that all matter described throughout this entire specification or shown in the accompanying drawings be interpreted as illustrative and not in a limiting sense. It should thus be evident that a device constructed according to the concept of the present invention, and reasonably equivalent thereto, will accomplish the objects of the present invention and otherwise substantially improve the art of controlling the position of a linearly reciprocating member relative to the position of a unidirectionally rotating member, and more specifically the art of valve position control in internal combustion engines.

I claim:

1. A device to control a valve position in relation to a unidirectionally rotating member, comprising:

valve drive wheel assembly means movable in a reciprocating rotational manner;

flexible arm assembly means in operative association with the unidirectionally rotating member and said valve drive wheel assembly means for driving said valve drive wheel assembly means in rotational reciprocation as the unidirectionally rotating member rotates, wherein said flexible arm assembly means includes a first link operatively connected to the unidirectionally rotating member, a second link operatively connected to said valve drive wheel assembly means, a pivot joining said first link and said second link, and biasing means for urging said first link and said second link into substantially axial juxtaposition; and flexible rod assembly means carried by said valve drive wheel assembly means for linearly reciprocating the valve.

2. A valve position control device, as set forth in claim 1, wherein said valve drive wheel assembly means includes a rotatable valve drive wheel, and anchor pin means for connecting said valve drive wheel to said second link.

3. A valve position control device, as set forth in claim 2, wherein said flexible rod assembly means includes a flexible rod attached to the periphery of said valve drive wheel, and sleeve means for attaching said flexible rod to the valve and which allows the valve to freely rotate about its longitudinal axis.

4. A valve position control device, as set forth in claim 3, wherein said flexible arm assembly means further includes adjustment means carried in an end of said second link for adjustably connecting said second link to said anchor pin means.

5. A valve position control device, as set forth in claim 4, wherein said flexible rod assembly means further includes connector means for adjustably attaching said flexible rod to said valve drive wheel.

6. A valve position control device, as set forth in claim 5, wherein said flexible rod assembly means further includes guide wheel means for supporting and guiding said flexible rod assembly means.

7. A valve position control device, as set forth in claim 6, wherein said guide wheel means further includes ancillary biasing means for urging said valve drive wheel in the direction which closes the valve.

8. A valve position control device, as set forth in claim 7, wherein said valve drive wheel assembly means further includes impact post means for decreasing forces exerted by the valve as it is closed.

9. A device to control a linearly reciprocating member position in relation to a unidirectionally rotating member, comprising:

drive wheel assembly means movable in a reciprocating rotational manner;

flexible arm assembly means in operative association with the unidirectionally rotating member and said drive wheel assembly means for driving said drive wheel assembly means in rotational reciprocation as the unidirectionally rotating member rotates, wherein said flexible arm assembly means includes a first link operatively connected to the unidirectionally rotating member, a second link operatively connected to said drive wheel assembly means, a pivot joining said first link and said second link, and biasing means for urging said first link and said second link into substantially axial juxtaposition; and flexible rod assembly means carried by said drive wheel assembly means for linearly reciprocating the linearly reciprocating member.

10. A linearly reciprocating member position control device, as set forth in claim 9, wherein said drive wheel assembly means includes a rotatable drive wheel, and anchor pin means for connecting said drive wheel to said second link.

11. A linearly reciprocating member position control device, as set forth in claim 10, wherein said flexible rod assembly means includes a flexible rod attached to the periphery of said drive wheel, and sleeve means for attaching said flexible rod to the stem of the linearly reciprocating member and which allows the linearly reciprocating member to freely rotate about its longitudinal axis.

12. A linearly reciprocating member position control device, as set forth in claim 11, wherein said flexible arm assembly means further includes adjustment means carried in an end of said second link for adjustably connecting said second link to said anchor pin means.

13. A linearly reciprocating member position control device, as set forth in claim 12, wherein said flexible rod assembly means further includes connector means for adjustably attaching said flexible rod to said drive wheel.

14. A linearly reciprocating member position control device, as set forth in claim 13, wherein said flexible rod assembly means further includes guide wheel means for supporting and guiding said flexible rod assembly means.

15. A linearly reciprocating member position control device, as set forth in claim 14, wherein said guide wheel means further includes ancillary biasing means for urging said drive wheel in the direction which moves the linearly reciprocating member in a first direction to a rest position.

16. A linearly reciprocating member position control device, as set forth in claim 15, wherein said drive wheel assembly means further includes impact post means for decreasing forces exerted by the linearly reciprocating member as it moves in a first direction to a rest position.

* * * * *